US012799704B2

(12) United States Patent
Rajamani et al.

(10) Patent No.: US 12,799,704 B2
(45) Date of Patent: Nov. 17, 2026

(54) END EFFECTOR POSITION ESTIMATION

(71) Applicant: Regents of the University of Minnesota, Minneapolis, MN (US)

(72) Inventors: Rajesh Rajamani, Minneapolis, MN (US); Gregory W. Johnson, Minneapolis, MN (US)

(73) Assignee: Regants of the University of Minnesota, Minnepolis (MN)

( * ) Notice: Subject to any disclaimer, the term of this patent is extended or adjusted under 35 U.S.C. 154(b) by 991 days.

(21) Appl. No.: 17/554,087

(22) Filed: Dec. 17, 2021

(65) Prior Publication Data

US 2022/0195689 A1 Jun. 23, 2022

Related U.S. Application Data

(60) Provisional application No. 63/127,521, filed on Dec. 18, 2020.

(51) Int. Cl.
*E02F 3/43* (2006.01)
*E02F 9/22* (2006.01)

(52) U.S. Cl.
CPC ..... *E02F 3/431* (2013.01); *E02F 9/2203* (2013.01); *E02F 9/226* (2013.01)

(58) Field of Classification Search
None
See application file for complete search history.

(56) References Cited

U.S. PATENT DOCUMENTS 6,704,619 B1 * 3/2004 Coleman ..... G05D 1/0255 701/472
8,352,129 B2 * 1/2013 Yuan ..... B66C 13/06 701/50

(Continued)

FOREIGN PATENT DOCUMENTS

CN 109917786 A 6/2019
CN 110030996 A 7/2019

(Continued)

OTHER PUBLICATIONS

Sun et al., "Pose and Position Estimation of Dozer Blade in 3-dimensional by Integration of IMU with Two RTK GPSs", Conference: 34th International Symposium on Automation and Robotics in Construction (ISARC), Jul. 2017, 6 pages.

(Continued)

*Primary Examiner* — Angela Y Ortiz
*Assistant Examiner* — Torrence S Marunda, II
(74) *Attorney, Agent, or Firm* — Dicke, Billig & Czaja, PLLC

(57) ABSTRACT

One example is directed to an end effector position estimation system for an off-road vehicle, which includes at least one inertial measurement unit (IMU) configured to be positioned on at least one of actuators and links of the vehicle that together move the end effector of the vehicle, and configured to generate measurement signals. The position estimation system includes at least one other IMU configured to be positioned on a base of the vehicle, and configured to generate other measurement signals. The position estimation system includes an estimation unit to estimate a position of the end effector of the vehicle based at least in part on the measurement signals and the other measurement signals, wherein the estimation unit is configured to perform an estimation method that removes an influence of terrain- (Continued)

induced vibrations and terrain slope in the measurement signals based on the other measurement signals.

19 Claims, 16 Drawing Sheets

(56) References Cited

U.S. PATENT DOCUMENTS

| | | | | |
|---|---|---|---|---|
| 8,914,154 | B2 * | 12/2014 | Stothers | F16F 15/002 700/280 |
| 8,954,194 | B2 | 2/2015 | Allis et al. | |
| 9,222,507 | B2 * | 12/2015 | Murphy | F16C 19/52 |
| 9,464,408 | B2 * | 10/2016 | Montgomery | E02F 9/245 |
| 9,746,329 | B2 | 8/2017 | Nichols et al. | |
| 9,771,240 | B2 | 9/2017 | Martin | |
| 10,066,370 | B2 * | 9/2018 | Faivre | E02F 9/2029 |
| RE47,648 | E | 10/2019 | Reeve et al. | |
| 11,085,170 | B2 * | 8/2021 | Roulston | E02F 3/844 |
| 11,499,292 | B2 * | 11/2022 | Velde | E02F 9/24 |
| 11,873,621 | B2 * | 1/2024 | Kean | E02F 9/2041 |
| 2003/0178964 | A1 | 9/2003 | Challoner | |
| 2004/0158355 | A1 * | 8/2004 | Holmqvist | G05D 1/0236 701/23 |
| 2010/0332032 | A1 | 12/2010 | Moriyama et al. | |
| 2014/0107832 | A1 * | 4/2014 | Danko | E02F 9/2029 700/193 |
| 2018/0016758 | A1 * | 1/2018 | Dolinar | G05D 1/248 |
| 2018/0037444 | A1 | 2/2018 | Henikl et al. | |
| 2018/0148085 | A1 | 5/2018 | Tan et al. | |
| 2018/0281929 | A1 * | 10/2018 | Popoola | B64C 13/28 |
| 2019/0079508 | A1 | 3/2019 | Gingold et al. | |
| 2019/0100205 | A1 | 4/2019 | Kean et al. | |
| 2019/0251696 | A1 | 8/2019 | Wang et al. | |
| 2019/0345697 | A1 | 11/2019 | Ishihara et al. | |
| 2020/0040547 | A1 | 2/2020 | Ogawa et al. | |
| 2020/0133299 | A1 | 4/2020 | Yamamoto et al. | |
| 2021/0087794 | A1 * | 3/2021 | Yamamoto | B60R 1/27 |

FOREIGN PATENT DOCUMENTS

| | | | |
|---|---|---|---|
| CN | 110030999 | A | 7/2019 |
| CN | 209181798 | U | 7/2019 |
| CN | 110081883 | A | 8/2019 |
| GB | 2571004 | A | 8/2019 |
| SG | 11201908411 | W | 10/2019 |
| WO | 2019130451 | A1 | 7/2019 |
| WO | 2019204717 | A1 | 10/2019 |

OTHER PUBLICATIONS

Wang et al., "Direction cosine matrix estimation with an inertial measurement unit", Elsevier, Mechanical Systems and Signal Processing vol. 109, Feb. 2018, pp. 268-284.

Zihajehzadeh et al., "A Cascaded Two-Step Kalman Filter for Estimation of Human Body Segment Orientation Using MEMS-IMU", Conference: 36th Annual International Conference of the IEEE Engineering in Medicine and Biology Society (EMBC), Aug. 2014, pp. 6270-6273.

Lin et al., "Inertial measurement unit-based iterative pose compensation algorithm for low-cost modular manipulator", Advances in Mechanical Engineering vol. 8 Issue 1, Jan. 2016, pp. 1-11.

Hedberg et al., "Industrial Robot Tool Position Estimation using Inertial Measurements in a Complementary Filter and an EKF", Elsevier, IFAC PapersOnline vol. 50 Issue 1, Jul. 2017, pp. 12748-12752.

Ali et al., "Calibration method for articulated industrial robots", Elsevier, Procedia Computer Science vol. 112, Sep. 2017, pp. 1601-1610.

Guzman et al., "Real-time Vehicle Roll Angle Estimation based on IoT low-cost devices and Neural Networks", Preprints, Apr. 2018, pp. 1-22.

Qi et al., "6 DOF long-range precision tracking system", 2004 IEEE International Conference on Systems, Man and Cybernetics vol. 6., 2004, pp. 5307-5311.

Stadelmann et al., "End-Effector Pose Correction for Versatile Large-Scale Multi-Robotic Systems", IEEE Robotics and Automation Letters vol. 4. No. 2, Apr. 2019, pp. 546-553.

Sandy et al., "Dynamically Decoupling Base and End-Effector Motion for Mobile Manipulation using Visual-Inertial Sensing", IEEE/RSJ International Conference on Intelligent Robots and Systems (IROS), Sep. 2017, pp. 6299-6306.

Ibrahim et al., "A System for Vehicle Collision and Rollover Detection", 2016 IEEE Canadian Conference on Electrical and Computer Engineering (CCECE), May 2016, pp. 1-6.

Cantelli et al., "A Joint-Angle Estimation Method for Industrial Manipulators Using Inertial Sensors", IIEEE/ASME Transactions on Mechatronics vol. 20. No. 5, Oct. 2015, pp. 2486-2495.

Kuo et al., "Robotics And Mechatronics", Proceedings of the 6th IFToMM International Symposium on Robotics and Mechatronics (ISRM 2019), Mechanisms and Machine Science Book 78, Sep. 2019, pp. 1-522, and particularly pp. 473-480.

* cited by examiner

END EFFECTOR POSITION ESTIMATION

CROSS-REFERENCE TO RELATED APPLICATIONS

This Non-Provisional patent application claims the benefit of the filing date of U.S. Provisional Patent Application Ser. No. 63/127,521, filed Dec. 18, 2020, entitled "End Effector Position Estimation", the entire teachings of which are incorporated herein by reference.

GOVERNMENT LICENSE RIGHTS

This invention was made with government support under CMMI-1562006 awarded by the National Science Foundation. The government has certain rights in the invention.

BACKGROUND

Position estimation of an end effector of an agricultural vehicle, construction vehicle, or other off-road vehicle system is currently either not done at all, or may be done using expensive sensors that involve extensive modifications to the vehicle (e.g., drilling a hole through the entire length of the piston rod in a hydraulic cylinder). Such measurements may also be done using potentiometers, which are contacting sensors and prone to frequent failure.

For these and other reasons, a need exists for the present invention.

SUMMARY

One example disclosed herein is directed to an end effector position estimation system for an off-road vehicle, which includes at least one inertial measurement unit (IMU) configured to be positioned on at least one of actuators and links of the vehicle that together move the end effector of the vehicle, and configured to generate measurement signals. The position estimation system includes at least one other IMU configured to be positioned on a base of the vehicle, and configured to generate other measurement signals. The position estimation system includes an estimation unit to estimate a position of the end effector of the vehicle based at least in part on the measurement signals and the other measurement signals, wherein the estimation unit is configured to perform an estimation method that removes an influence of terrain-induced vibrations and terrain slope in the measurement signals based on the other measurement signals.

The estimation method may include adaptive feedforward disturbance removal. The estimation unit may estimate a real-time rotation or translation of each of the actuators and links in order to estimate the position of the end effector. The off-road vehicle may be an agricultural vehicle. The off-road vehicle may be a construction vehicle. The off-road vehicle may be a telehandler. The off-road vehicle may be another type of vehicle.

The end effector position estimation system may further include at least one range or linear translational position sensor to generate range information based on translation motions of at least one link of the vehicle with linear translational degrees of freedom; and the estimation unit may be configured to estimate the position of the end effector based further on the generated range information. The at least one range or linear translational position sensor may include a low-cost laser sensor. The end effector position estimation system may further include a combination of an inexpensive low bandwidth range sensor located on a translating arm of the vehicle together with an IMU located at a moving end of the translating arm to generate together an estimate of a translational motion of at least one link of the vehicle with linear translational degrees of freedom; and the estimation unit may be configured to estimate the position of the end effector based further on the generated estimate of translation motion.

The estimation unit may be configured to determine whether the vehicle is operating within safe operating limits based at least in part on the estimated position of the end effector. The estimation unit may be configured to determine whether the vehicle is operating within safe operating limits based further on an estimated weight of a load carried by the end effector. The system may be configured to control the vehicle to prevent vehicle tip over based at least in part on the estimated position of the end effector. The system may be configured to prevent motion of the end effector into regions that may cause the vehicle to tip-over. The system may be configured to prevent motion of the end effector into a restricted region. The restricted region may comprise a wall, and the system may be configured to prevent the end effector from contacting the wall.

Another example disclosed herein is directed to an end effector position estimation system for an off-road vehicle, which includes at least one inertial measurement unit (IMU) to be positioned on at least one of actuators and links of the vehicle that together move the end effector of the vehicle, and to generate measurement signals. The end effector position estimation system includes at least one other IMU to be positioned on a base of the vehicle, and to generate other measurement signals. The end effector position estimation system includes at least one laser range sensor to generate range information based on translation motion of at least one of the links of the vehicle with linear translational degrees of freedom. The end effector position estimation system includes an estimation unit to estimate real-time rotation or translation of each of the actuators and links based on the measurement signals, other measurement signals, and range information, and to estimate a position of the end effector of the vehicle based on the estimated real-time rotation or translation of each of the actuators and links.

The estimation unit may remove an influence of terrain-induced vibrations and terrain slope in the measurement signals based on the other measurement signals. The estimation unit may determine whether the vehicle is operating within safe operating limits based at least in part on the estimated position of the end effector. The system may control the vehicle to prevent vehicle tip over based on the estimated position of the end effector and an estimated weight of a load carried by the end effector.

Yet another example disclosed herein is directed to a method, which includes generating measurement signals with at least one inertial measurement unit (IMU) positioned on at least one of actuators and links of an off-road vehicle that together move an end effector of the vehicle, and generating other measurement signals with at least one other IMU configured to be positioned on a base of the vehicle. The method includes compensating the measurement signals based on the other measurement signals, and estimating a position of the end effector of the vehicle based at least in part on the compensated measurement signals. The method may further include determining whether the vehicle is operating within safe operating limits based at least in part on the estimated position of the end effector.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Figure 1:
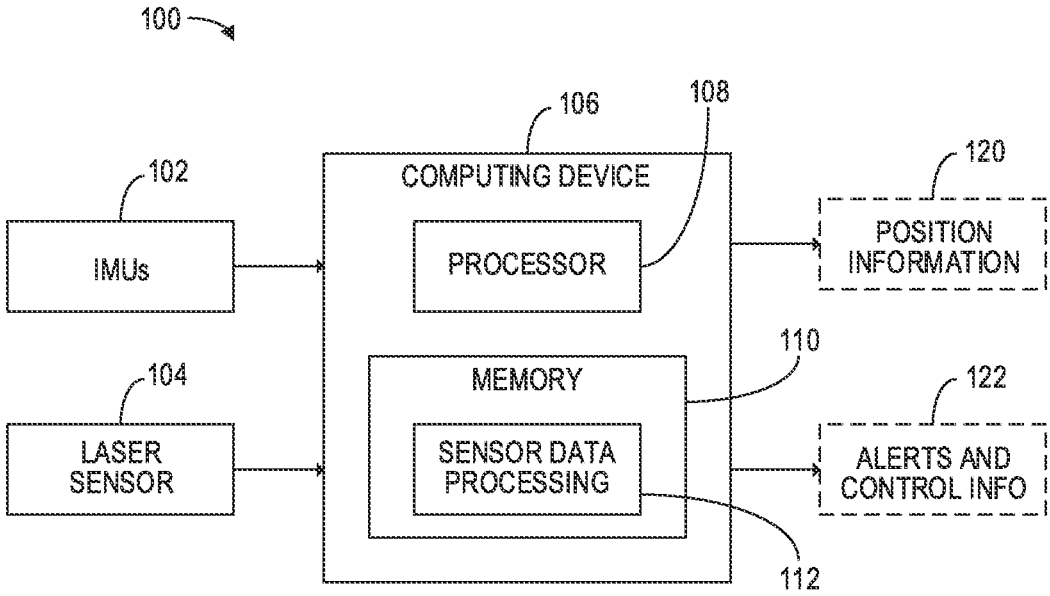
FIG. 1 is a block diagram illustrating a system for estimating position according to one example.

Some examples disclosed herein are directed to an inertial measurement unit based end effector position estimation and tip-over prevention system. FIG. 1 is a block diagram illustrating a system 100 for estimating position according to one example. System 100 includes a plurality of inertial measurement units (IMUs) 102, a laser range finder sensor 104, and a computing device 106. Individual ones of the IMUs 102 may be individually addressed herein with an appended number after "102" (e.g., 102(1), 102(2), etc.). The computing device 106 includes a processor 108 and a memory 110. Memory 110 stores sensor data processing module 112.

Depending on the exact configuration and type of computing device, the memory 110 may be volatile (such as RAM), non-volatile (such as ROM, flash memory, etc.), or some combination of the two. The memory 110 used by computing device 106 is an example of computer storage media (e.g., non-transitory computer-readable storage media storing computer-executable instructions for performing a method). Computer storage media used by computing device 106 according to one example includes volatile and nonvolatile, removable and non-removable media implemented in any suitable method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium that can be used to store the desired information and that can be accessed by processor 108.

In some examples, system 100 utilizes IMUs 102 to provide sensor information for estimation of rotational and translational variables. Each IMU 102 may be implemented as an IMU sensor chip that includes a 3-axis accelerometer and a 3-axis gyroscope. In some examples, the IMUs 102 may also each include a 3-axis magnetometer. Thus, each IMU 102 provides either six or nine measurement signals (i.e., three accelerations from the three accelerometers, three rotational rates from the three gyroscopes, and, in some examples, three magnetic field intensities from the three magnetometers). In some examples, the IMU sensor chip may include a microcontroller, a battery, and a wireless transceiver (e.g., Bluetooth) and antenna. In some examples, the IMU sensor chip may include an Inter-Integrated Circuit (I2C) or Serial Peripheral Interface (SPI) communications interface. The accelerometer in each IMU 102 may measure both linear acceleration and gravity. Measurements of gravity in static positions allow estimation of vertical tilt angle. Measurements of the rotation rates allow dynamic estimation of tilt angle.

IMUs 102 and laser sensor 104 output sensor information to computing device 106. Processor 108 executes sensor data processing module 112 to perform a position estimation method, and other methods disclosed herein, using the received sensor information. Sensor data processing module 112 outputs position information 120 and alerts and control information 122, based on the processing of the received sensor information. In some examples, system 100 may be used as an IMU-based end effector position estimation system for agricultural vehicles, construction vehicles, and other off-road vehicle systems, and the position information 120 indicates a current position of the end effector. In some examples, the system 100 estimates the position of an end effector of the vehicle, and also detects if a vehicle tip-over is likely to occur, so that such a tip-over event can be prevented. The alerts and control information 122 may include an audible and/or visual alert that a tip-over event is about to occur so that an operator can prevent the occurrence, and/or it may include control information to automatically control the vehicle to prevent the tip-over event from occurring.

At least one of the IMUs 102 may be located on actuators and/or links that together move the end effector of the vehicle. At least one of the IMUs 102 may be located on a base of the vehicle. The position estimation method performed by sensor data processing module 112 may include removing the influence of terrain induced vibrations and terrain slope (e.g., measured by an IMU 102 on the vehicle base) from the signals of the IMUs 102 located on the actuators or links. In some examples, the position estimation method includes adaptive feedforward disturbance removal and other signal processing methods. Sensor data processing module 112 may estimate the real-time rotation or translation of each actuator or link of the vehicle, in order to estimate the end effector position. Sensor data processing module 112 may also determine if the end effector position and the weight of the load carried by the end effector will cause vehicle tip-over.

Figure 2:
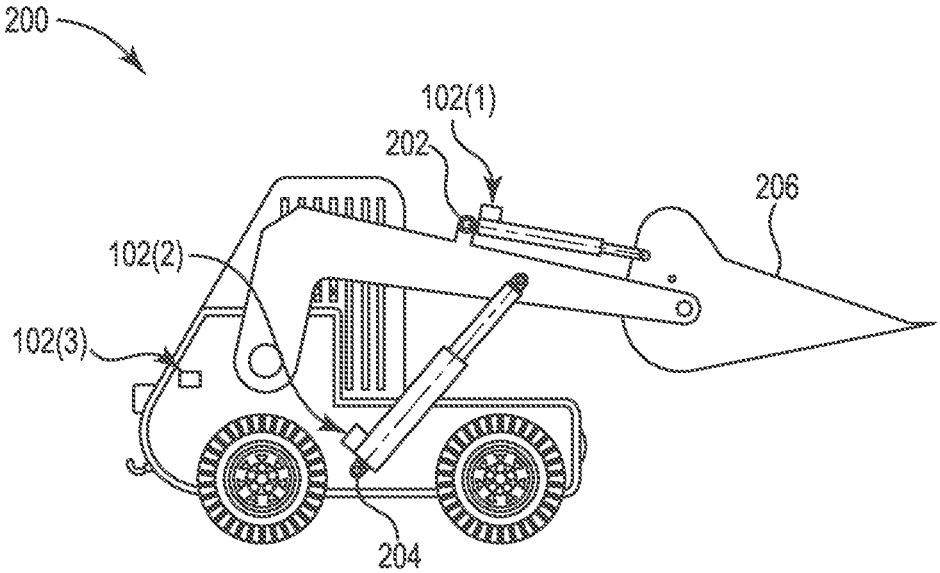
FIG. 2 is a diagram illustrating a compact wheel loader vehicle with a position estimation system that measures two rotational motions to determine end effector position according to one example.

FIG. 2 is a diagram illustrating a compact wheel loader vehicle 200 with a position estimation system that measures two rotational motions to determine end effector position according to one example. Compact wheel loader vehicle 200 includes two hydraulic actuators 202 and 204 to move the end effector 206, which is a bucket in this example. The two hydraulic actuators include a lift hydraulic actuator 202 and a tilt hydraulic actuator 204. Each of the two actuators 202 and 204 has a rotational motion as part of a kinematic mechanism while it is being actuated. A first IMU 102(1) is positioned on the lift hydraulic actuator 202, and a second IMU 102(2) is positioned on the tilt hydraulic actuator 204. The IMUs 102(1) and 102(2) on the actuators 202 and 204, respectively, may be used to estimate their real-time inertial rotational angles. In addition, a reference IMU 102(3) located on the vehicle base may be used to measure reference signals that can be used to compensate for terrain slope and terrain induced vibrations. Other elements of system 100 (FIG. 1), such as computing device 106, may also be positioned on or in vehicle 200.

Figure 3A:
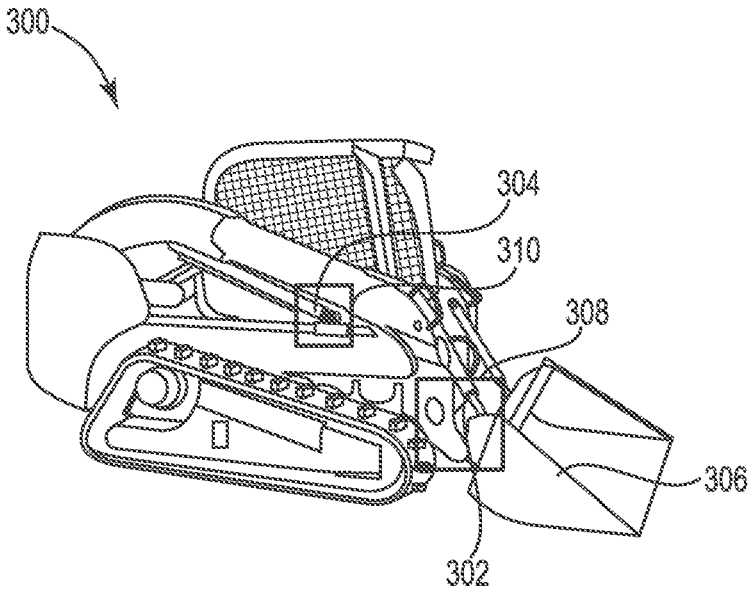
FIG. 3A is a diagram illustrating a commercial track loader vehicle with a position estimation system that measures two rotational motions to determine end effector position according to one example.
Figure 3B:
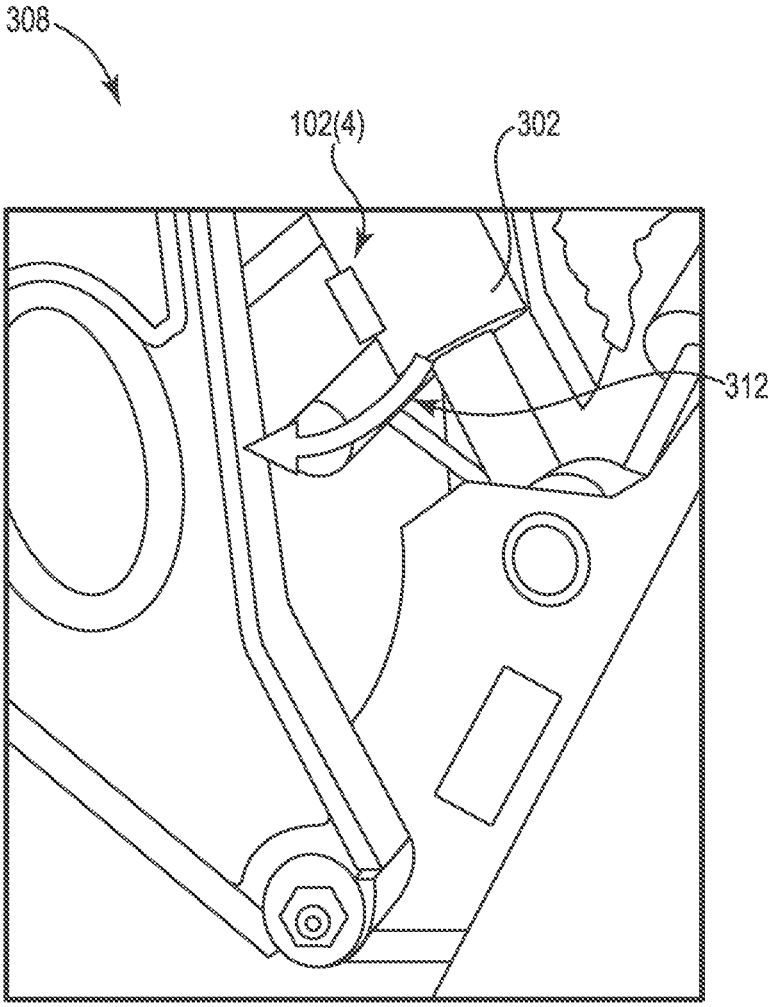
FIG. 3B is a diagram illustrating a zoomed-in view of a portion of the lift actuator of the commercial track loader vehicle shown in FIG. 3A according to one example.
Figure 3C:
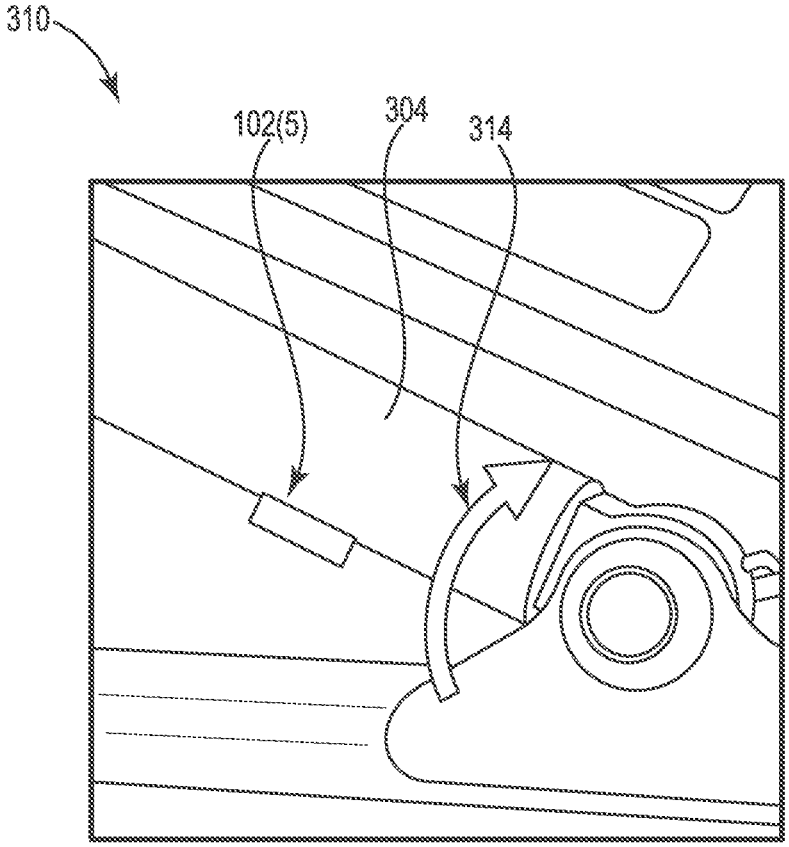
FIG. 3C is a diagram illustrating a zoomed-in view of a portion of the tilt actuator of the commercial track loader vehicle shown in FIG. 3A according to one example.

FIG. 3A is a diagram illustrating a commercial track loader 300 with a position estimation system that measures two rotational motions to determine end effector position according to one example. FIG. 3B is a diagram illustrating a zoomed-in view of a portion 308 of the lift actuator of the commercial track loader vehicle 300 shown in FIG. 3A according to one example. FIG. 3C is a diagram illustrating a zoomed-in view of a portion 310 of the tilt actuator of the commercial track loader vehicle 300 shown in FIG. 3A according to one example.

Commercial track loader vehicle 300 includes two hydraulic actuators 302 and 304 to move the end effector 306, which is a bucket in this example. The two hydraulic actuators include a lift hydraulic actuator 302 and a tilt hydraulic actuator 304. The two actuators 302 and 304 undergo rotational motion when they are used to move the end effector 306. Hence, measuring the rotational angles on these two actuators provides information to estimate the end effector position. As shown in FIG. 3B, a first IMU 102(4) is positioned on the lift hydraulic actuator 302 to measure rotational angle 312 of the lift hydraulic actuator 302. As shown in FIG. 3C, a second IMU 102(5) is positioned on the tilt hydraulic actuator 304 to measure rotational angle 314 of the tilt hydraulic actuator 304. The IMUs 102(4) and 102(5) on the actuators 302 and 304, respectively, may be used to estimate their real-time inertial rotational angles, and based on this information, the position of the end effector 306 may be determined by system 100.

While the IMUs 102 on actuators or links can estimate rotational angles of these components, such IMUs 102 may also measure the influence of terrain induced vehicle vibrations. Such terrain-induced vehicle vibrations may cause errors in the estimated orientation angles. Some examples disclosed herein detect and compensate for such terrain induced vehicle vibrations.

Figure 4A:
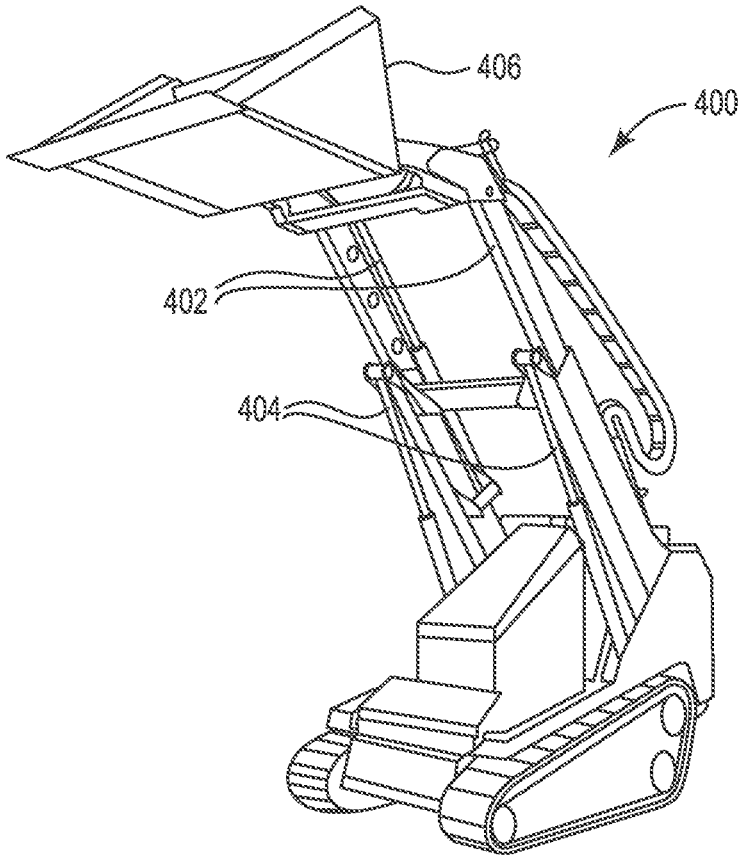
FIG. 4A is a diagram illustrating a compact track loader vehicle with a position estimation system that measures one rotational motion and one translational motion to determine end effector position according to one example.

FIG. 4A is a diagram illustrating a compact track loader vehicle 400 with a position estimation system that measures one rotational motion and one translational motion to determine end effector position according to one example. Compact track loader vehicle 400 includes a pair of lift hydraulic actuators 402 and a pair of tilt hydraulic actuators 404 to move the end effector 406, which is a bucket in this example. The tilt hydraulic actuators 404 undergo rotational motion, which also causes equivalent rotational motion of the lift hydraulic actuators 402. In addition, the lift hydraulic actuators 402 cause translational motion of the end effector 406. Thus, in this case, the rotational tilt motion and the translational motion of the piston rod of the lift hydraulic actuators 402 are estimated by system 100.

Figure 4B:
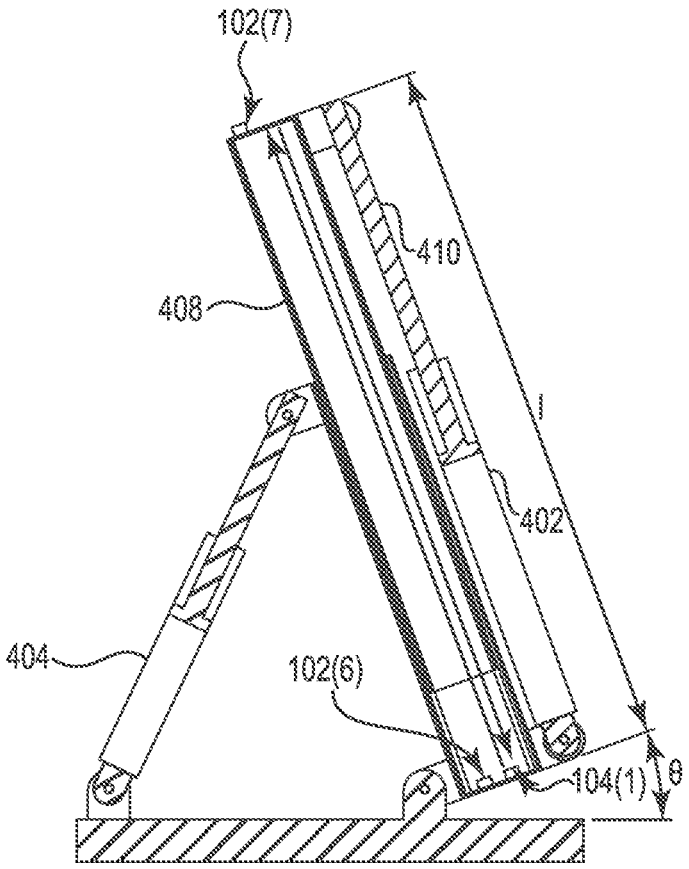
FIG. 4B is a diagram illustrating a lift hydraulic actuator and a tilt hydraulic actuator of the compact track loader vehicle shown in FIG. 4A according to one example.

FIG. 4B is a diagram illustrating a lift hydraulic actuator 402 and a tilt hydraulic actuator 404 of the compact track loader vehicle 400 shown in FIG. 4A according to one example. As shown in FIG. 4B, a first IMU 102(6) located inside a telescoping arm 408 may be used to estimate tilt angle, $\theta$, while a laser sensor 104(1) at the same location, which measures the current length, l, of the telescoping arm 408, together with a second IMU 102(7) located at the end of the piston rod 410 of the lift hydraulic actuator 402, which measures linear acceleration, $a_x$, may all be used to estimate bucket position.

In some examples, sensor data processing module 112 (FIG. 1) performs a method of estimating tilt angle of an actuator using an IMU 102. The module 112 may use the known direction and magnitude of gravity and the components of static acceleration values along the 3-axes of the IMU sensor 102 to calculate orientation of the IMU 102 with respect to gravity. This provides both vertical tilt angles of the link or actuator on which the IMU 102 is located. The module 112 may combine in a Kalman Filter (or other estimator) the static vertical angles from the accelerometers with the gyroscope signals along both these axes to calculate vertical tilt angles that are both statically correct and have high bandwidth. Additional details related to this method may be found in Y. Wang and R. Rajamani, "Direction Cosine Matrix Estimation with an Inertial Measurement Unit," Mechanical Systems and Signal Processing, Vol. 109, pp. 268-284, 1 Sep. 2018, which is hereby incorporated by reference herein.

To determine the vertical tilt angles from the accelerometer signals, the sensor data processing module 112 finds the third column of the direction cosine matrix (DCM) using the following Equation I:

$$v_3 = -\frac{1}{g}\begin{bmatrix} a_x \\ a_y \\ a_z \end{bmatrix} \quad \text{Equation I}$$

where: $a_x$, $a_y$ and $a_z$ are measured accelerations along the sensor axes.

The third column of the DCM is given by the following Equation II:

$$v_3 = \begin{bmatrix} -\sin(\theta_{accels}) \\ \cos(\theta_{accels})\sin(\phi_{accels}) \\ \cos(\phi_{accels})\cos(\theta_{accels}) \end{bmatrix} \quad \text{Equation II}$$

The two vertical angles $\theta_{accels}$ and $\phi_{accels}$ can be obtained from the estimate of $v_3$. Here, $\theta_{accels}$ is the vertical angle of interest (i.e., the tilt angle). The static tilt angle $\theta_{accels}$ from the gravity component can be combined with the gyroscope measurement to obtain a drift-free high bandwidth tilt angle as shown in the following Equation III:

$$\dot{\hat{\theta}} = \dot{\theta}_{gyro} + p(\theta_{accels} - \hat{\theta}) \quad \text{Equation III}$$

Figure 5:
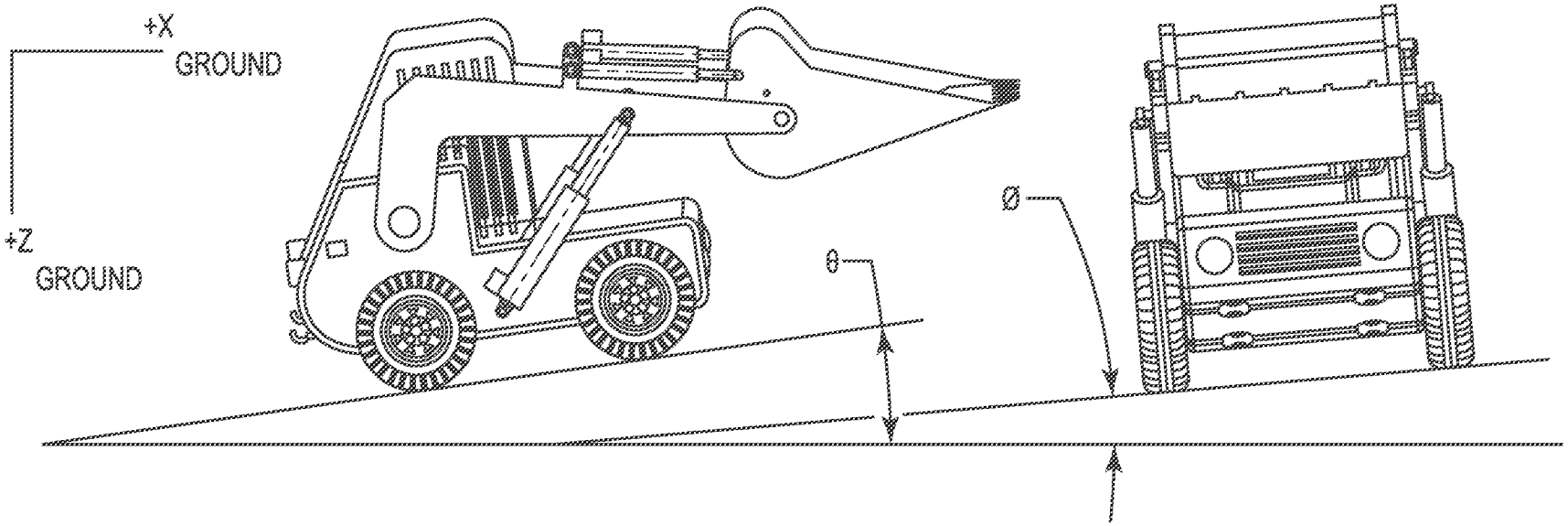
FIG. 5 is a diagram illustrating definitions of tilt angle, $\theta$, and roll angle, $\phi$, of terrain according to one example.
Figure 6:
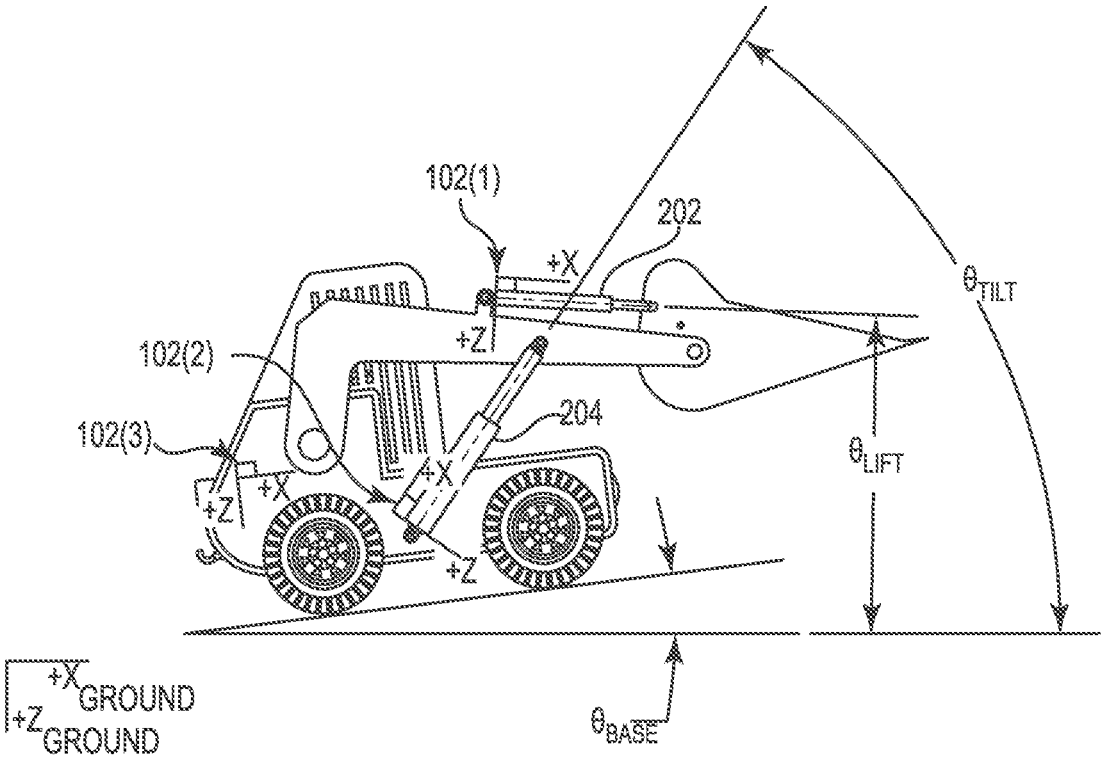
FIG. 6 is a diagram illustrating definitions of inertial tilt angles of a vehicle base, of a tilt actuator, and of a lift actuator according to one example.

FIG. 5 is a diagram illustrating definitions of tilt angle, θ, and roll angle, ϕ, of terrain according to one example. FIG. 6 is a diagram illustrating definitions of inertial tilt angles of a vehicle base, of a tilt actuator, and of a lift actuator according to one example. As shown in FIG. 6, IMU 102(3) is positioned on the vehicle base. The IMU 102(3) may be utilized to estimate the tilt angle of the base, $\theta_{base}$. The IMU 102(2) on the tilt actuator (or link) 204 may be used to estimate the inertial tilt angle of the tilt arm, $\theta_{tilt}$. The IMU 102(1) on the lift actuator (or link) 202 may be used to estimate the inertial tilt angle of the lift link, $\theta_{lift}$.

In some examples, sensor data processing module 112 (FIG. 1) performs a method of removing the influence of terrain-induced slope and vibrations on acceleration signals. The module 112 may use the accelerometers and gyroscopes of the IMU 102(3) on the vehicle base to provide a reference signal related to upstream measurement of terrain-induced disturbances that influence the accelerometers and gyroscopes on the actuator. The module 112 may use an adaptive feedforward least-mean-squares algorithm to remove the influence of the disturbances in real-time on the actuator-mounted sensors. For this method, $\theta_{base\text{-}lowpass}$ is the estimated lowpass filtered tilt angle of the base. This variable retains the information of road slope and static angle of the base, but does not retain high frequency vibrations. For this method, $\dot{\theta}_{base}$ is the gyroscope measured angular rate of the base. This signal retains both the influence of road slope and of road-induced vibrations. The following base tilt angle estimate is then utilized as the reference:

$$\dot{\hat{\theta}}_{base} = \dot{\theta}_{base} + \ell_i(\theta_{base-lowpass} - \hat{\theta}) \quad \text{Equation IV}$$

Let $\theta_{actuator}$ be the estimated inertial tilt angle of the actuator. Then the road induced disturbance on the actuator can be estimated as follows.

A reference road-disturbance influence vector is obtained as shown in the following Equation V:

$$x(n) = [\hat{\theta}_{base}(n)\ \hat{\theta}_{base}(n-1)\ \ldots\ \hat{\theta}_{base}(n-N)] \quad \text{Equation V}$$

The parameter vector is given in the following Equation VI:

$$w(n) = [w_0\ w_1\ \ldots\ w_N] \quad \text{Equation VI}$$

The disturbance-free relative tilt angle is given in the following Equation VII:

$$\theta_{relative}(n) = \theta_{actuator} - w^T(n)x(n) \quad \text{Equation VII}$$

The adaptive estimator for the filter parameters is given in the following Equation VIII:

$$w(n+1) = w(n) + \mu e(n)x(n). \quad \text{Equation VIII}$$

The desired actuator relative tilt angle is thus obtained as $\theta_{relative}$.

In some examples, sensor data processing module 112 (FIG. 1) performs a method of computing linear position using an accelerometer of an IMU 102, and a low-bandwidth laser sensor 104. In this method, as shown in FIG. 4B, the measured acceleration along the linear actuator (on the piston rod) is $a_x$ and the laser sensor measured low-bandwidth position is $x_{lazer}$. Then, a high bandwidth drift-free estimate of linear position can be obtained using the following Equations IX and X:

$$\dot{\hat{x}} = \hat{v} + k_1(\hat{x} - x_{laser}) \quad \text{Equation IX}$$

$$\dot{\hat{v}} = a_x + k_2(\hat{x} - x_{laser}) \quad \text{Equation X}$$

where: the gain vector $[k_1\ k_2]^T$ is chosen so as to stabilize the matrix $$\begin{bmatrix} 0 & 1 \\ 0 & 0 \end{bmatrix} + \begin{bmatrix} k_1 \\ k_2 \end{bmatrix}[1\ \ 0].$$

In some examples, sensor data processing module 112 (FIG. 1) performs a method of computing end effector position from IMUs 102. In some examples, the method includes the following: (1) The vertical angle of each kinematic link on the machine is measured using an IMU 102, relative to ground (gravity direction); (2) the relative tilt angle between each link and the base is estimated as previously discussed above; and (3) as each kinematic link is of a known length, the end effector position can be recovered from the estimated angles using a forward kinematics equation.

As an example of this method, consider a construction vehicle that includes a vehicle base, and two rotating links (the method holds generally for m links) with an IMU 102 placed on each link. When the vehicle is on flat ground, all link rotation axes are horizontal. Let vectors $p_1$ and $p_2$ define the positions of points on the links of the machine. Each vector consists of the three coordinates x, y and z. Let each link have its own local coordinate system, such that $p_1$ and $p_2$ expressed in the link frame of reference, $$p_1^L$$

and $$p_2^L$$

are as follows, where $l_m$ is the length of the mth link:

$$p_m^{link} = [l_m \ 0 \ 0]^T \qquad \text{Equation XI}$$

Define $p_E$ as the position vector of the end effector, relative to the joint between the base of the vehicle and the first link. Then $p_{end}$ can be expressed as:

$$p_{end} = p_1 + p_2 \qquad \text{Equation XII}$$

Figure 7:
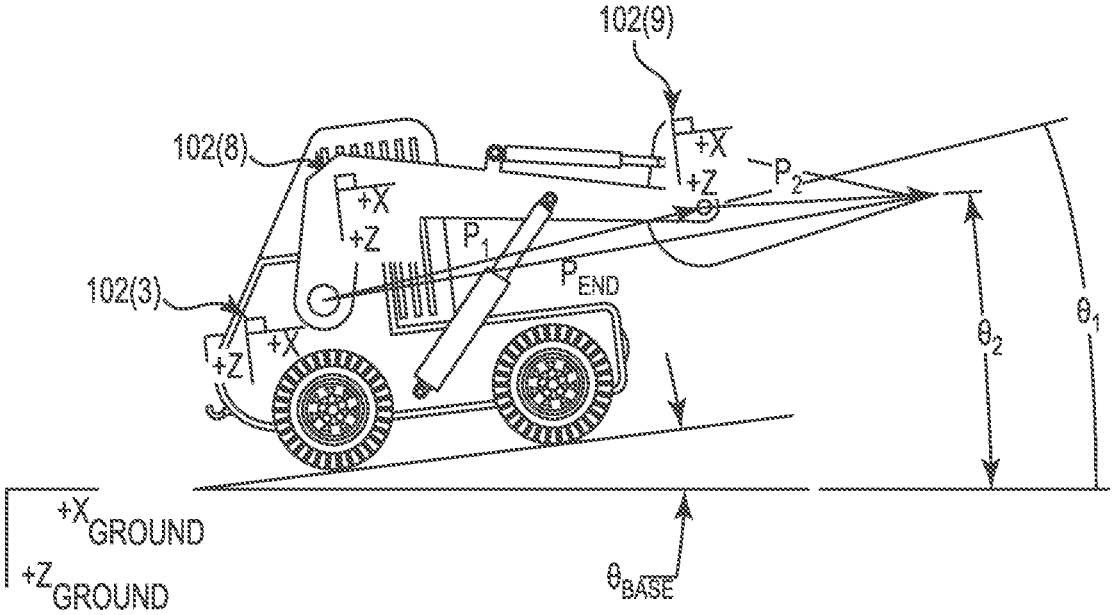
FIG. 7 is a diagram illustrating a vehicle with positions of points on links and of an end effector according to one example.

FIG. 7 is a diagram illustrating a vehicle with positions of such points on links and of an end effector according to one example. As shown in FIG. 7, the vehicle includes IMUs 102(3), 102(8), and 102(9).

To express $p_{end}$ in the base frame of reference, $$p_{end}^{base},$$

the position vector of each link is expressed in the base frame of reference, which can be accomplished with direction cosine matrices. Let $$R_j^k$$

be the direction cosine matrix that will express a vector in the jth frame to its representation in the kth frame:

$$p^k = R_j^k p^j \qquad \text{Equation XIII}$$

Thus, the end effector position in the machine coordinate system can be expressed as:

$$p_{end}^{base} = R_{ground}^{base} R_1^{ground} p_1^{link} + R_{ground}^{base} R_2^{ground} p_2^{link} \qquad \text{Equation XIV}$$

As the method is not concerned with the horizontal plane (yaw) angle in this example, the ground frame of reference is defined such that the ground z-axis is aligned with gravity (pointing downwards), and the ground x-axis is coplanar with the ground z-axis and the base and link x-axes. That is, the ground y-axis will have zero x component when expressed in the base or link frame of reference:

$$R_{ground}^{base}\begin{bmatrix}0\\1\\0\end{bmatrix} = R_{ground}^{link}\begin{bmatrix}0\\1\\0\end{bmatrix} = \begin{bmatrix}0\\-\\-\end{bmatrix} \qquad \text{Equation XV}$$

Equation XV implies that the (1,2) entries of $$R_{ground}^{base}$$

and $$R_{ground}^{link}$$

are always zero. When using the terrain-induced slope and vibration technique described above, $\theta_{relative}(n)$ is estimated for each link, which fully constrains the rotation matrix of each link relative to the base, $$R_{link}^{base}(n).$$

Thus, the end effector position may be recovered as follows:

$$p_{end}^{base}(n) = R_1^{base}(n) p_1^{link} + R_2^{base}(n) p_2^{link} \qquad \text{Equation XVI}$$

In the case when a link has a translational component as well as a rotational component, then the position vector in the link frame of reference is no longer a static value. Here, we may use the estimate of actuator linear position to estimate the link length, l(n), and we can write:

$$p_m^{link}(n) = [l_m(n) \ 0 \ 0]^T \qquad \text{Equation XVII}$$

Suppose in the two link example considered here that the second link has a translational component, then the end effector position can be estimated as:

$$p_{end}^{base}(n) = R_1^{base}(n) p_1^{link} + R_2^{base}(n) p_2^{link}(n) \qquad \text{Equation XVIII}$$

Figure 8:
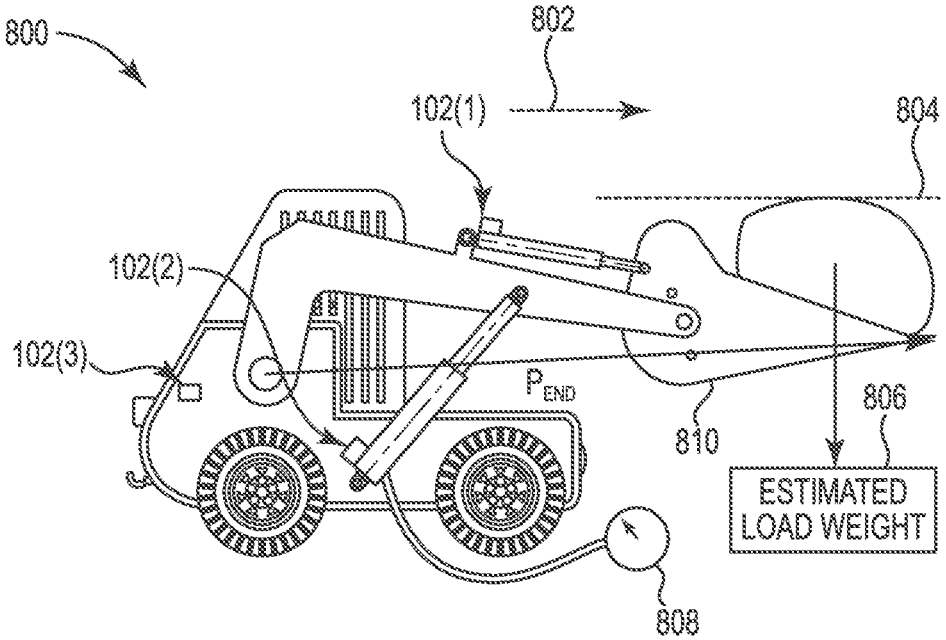
FIG. 8 is a diagram illustrating a vehicle with a tip-over prevention system according to one example.

In some examples, sensor data processing module 112 (FIG. 1) performs a method for preventing tip over of vehicles using end effector position estimation. FIG. 8 is a diagram illustrating a vehicle 800 with a tip-over prevention system according to one example. In some examples, the method includes the following three steps:

(1) The end effector position is estimated using a combination of IMUs 102(1)-102(3) and laser sensors 104 (FIG. 1). The IMUs 102(1)-102(3) help estimate rotational tilt angles of links and also help estimate linear translational motion in the case of equipment with telescoping links, as has been described above.

(2) The moment arm (tilt inducing moment or torque) of the load carried by the end effector 810 is estimated in real time as a function of the position of the end effector 810 and of the weight carried. The weight carried may be estimated from the actuator hydraulic pressure using hydraulic pressure sensor 808, or by any other means of determining an estimated load weight 806.

(3) The range of motion of the end effector 810 and the speed of travel of the vehicle 800 may be limited by system 100 (FIG. 1) to a safe operating limit 802, such that the weight carried by the end effector 810 will not cause the vehicle to tip over. For example, the range of motion could be limited by system 100 such that the height of the end effector 810 together with a knowledge of the estimated weight load 806 does not exceed a specified threshold (e.g., lift height limit 804). The speed and acceleration of the vehicle 800 may also be limited, since longitudinal acceleration causes load transfer from front to rear wheels, thus increasing the danger of tip over.

Figure 9:
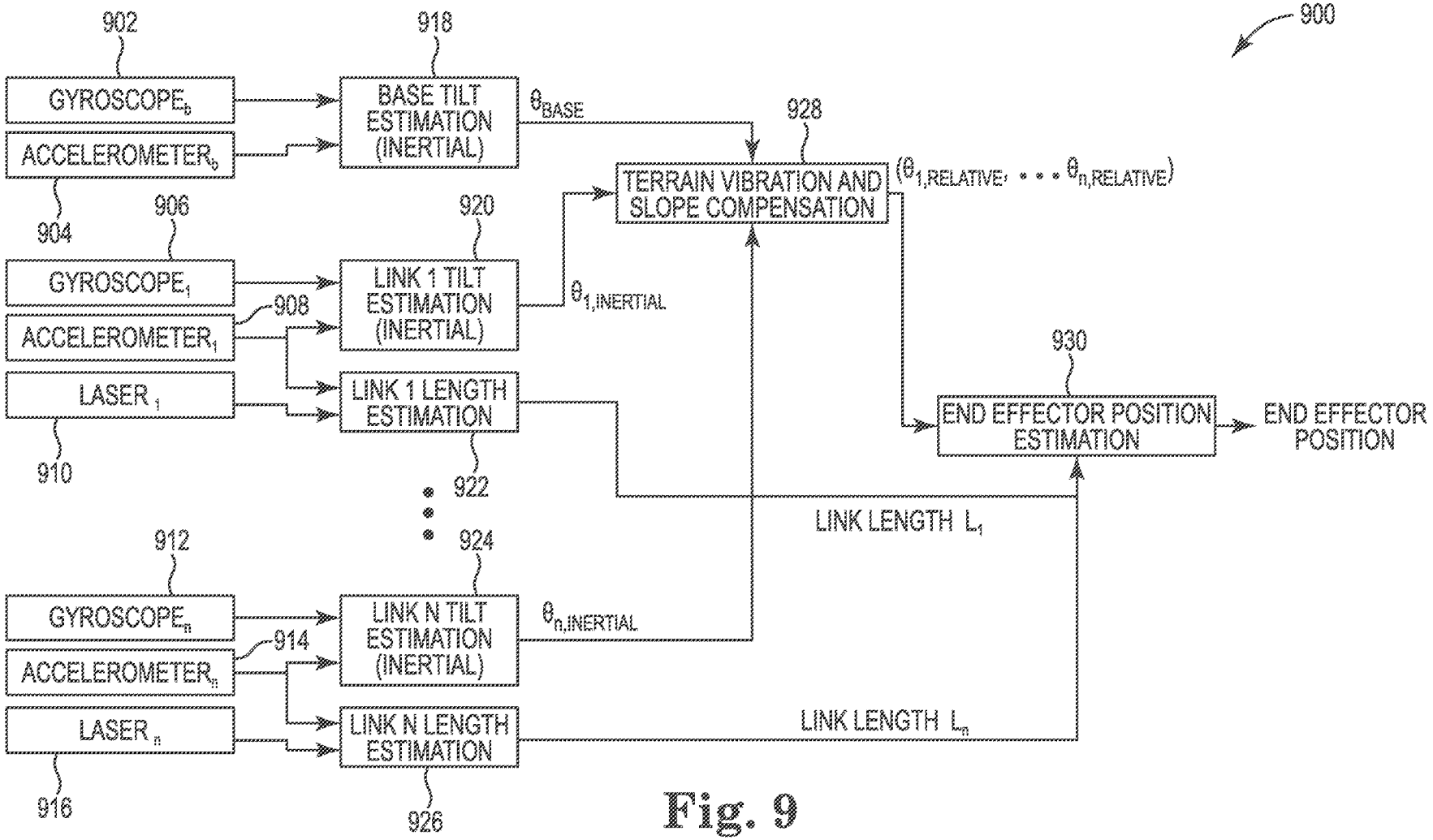
FIG. 9 is a flow diagram illustrating a method for estimating position of an end effector according to one example.

FIG. 9 is a flow diagram illustrating a method 900 for estimating position of an end effector according to one example. Gyroscope$_b$ 902 and accelerometer$_b$ 904 provide sensor data to base tilt estimation (inertial) unit 918. Gyroscope$_1$ 906 and accelerometer$_1$ 908 provide sensor data to link 1 tilt estimation (inertial) unit 920. Accelerometer$_1$ 908 and laser$_1$ 910 provide sensor data to link 1 length estimation unit 922. Gyroscope$_n$ 912 and accelerometer$_n$ 914 provide sensor data to link n tilt estimation (inertial) unit 924. Accelerometer$_n$ 914 and laser$_n$ 916 provide sensor data to link n length estimation unit 926. Note that laser and link length estimation steps may be present only on links with variable lengths (e.g., extension booms).

Based on the received sensor information, base tilt estimation (inertial) unit 918 determines base tilt values, $\theta_{base}$, which are provided to terrain vibration and slope compensation unit 928. Link 1 tilt estimation (inertial) unit 920 provides tilt values, $\theta_{1,inertial}$, to terrain vibration and slope compensation unit 928. Link n tilt estimation (inertial) unit 924 provides tilt values, $\theta_{n,inertial}$, to terrain vibration and slope compensation unit 928. Based on the received information, terrain vibration and slope compensation unit 928 determines tilt values, $(\theta_{1,relative}, \ldots, \theta_{n,relative})$, which are provided to end effector position estimation unit 930.

Based on received sensor information, link 1 length estimation unit 922 determines a link length $l_1$, which is provided to end effector position estimation unit 930. Based on received sensor information, link n length estimation unit 926 determines a link length $l_n$, which is provided to end effector position estimation unit 930. Based on the information received from units 928, 922, and 926, end effector position estimation unit 930 determines an end effector position.

Figure 10:
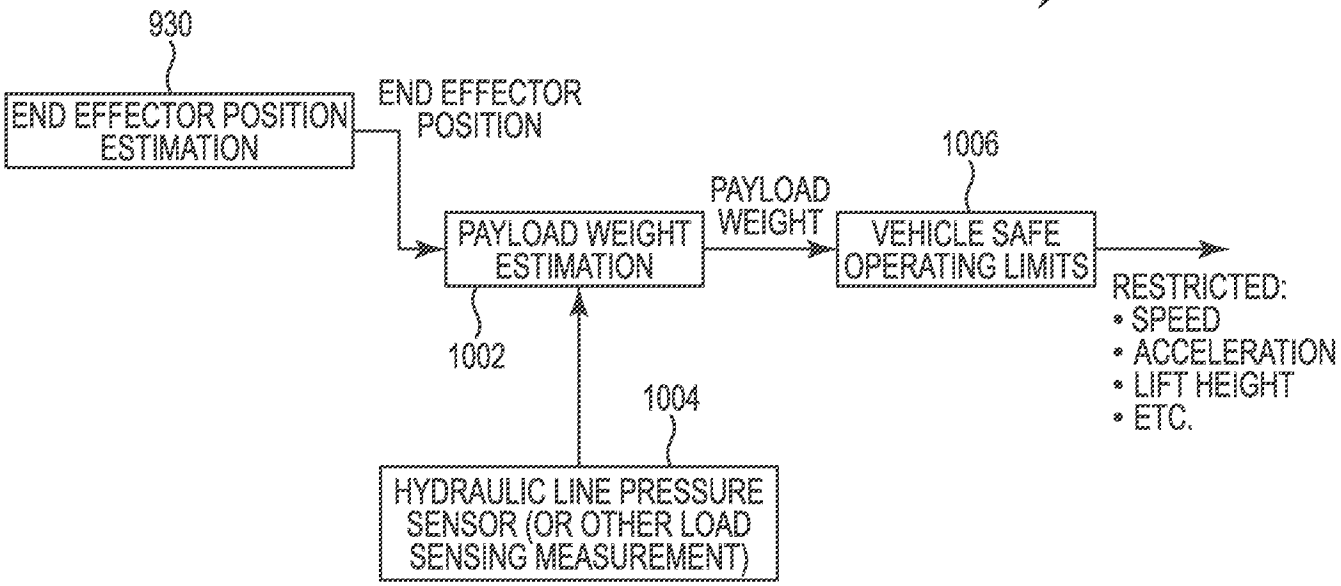
FIG. 10 is a flow diagram illustrating a method for tip-over prevention of a vehicle according to one example.

FIG. 10 is a flow diagram illustrating a method 1000 for tip-over prevention of a vehicle according to one example. End effector position estimation unit 930 receives information as shown in FIG. 9, and determines an end effector position, which is provided to payload weight estimation unit 1002. Hydraulic line pressure sensor (or other load sensing measurement) 1004 provides hydraulic line pressure measurements to payload weight estimation unit 1002. Based on information received from units 930 and 1004, payload weight estimation unit 1002 determines an estimated payload weight, which is provided to vehicle safe operating limits unit 1006 along with the estimated end effector position. Based on the received information, vehicle safe operating limits unit 1006 controls the vehicle to prevent a tip over event, which may include restricting speed, acceleration, lift height of the end effector, as well as other aspects of vehicle operation.

Figure 11:
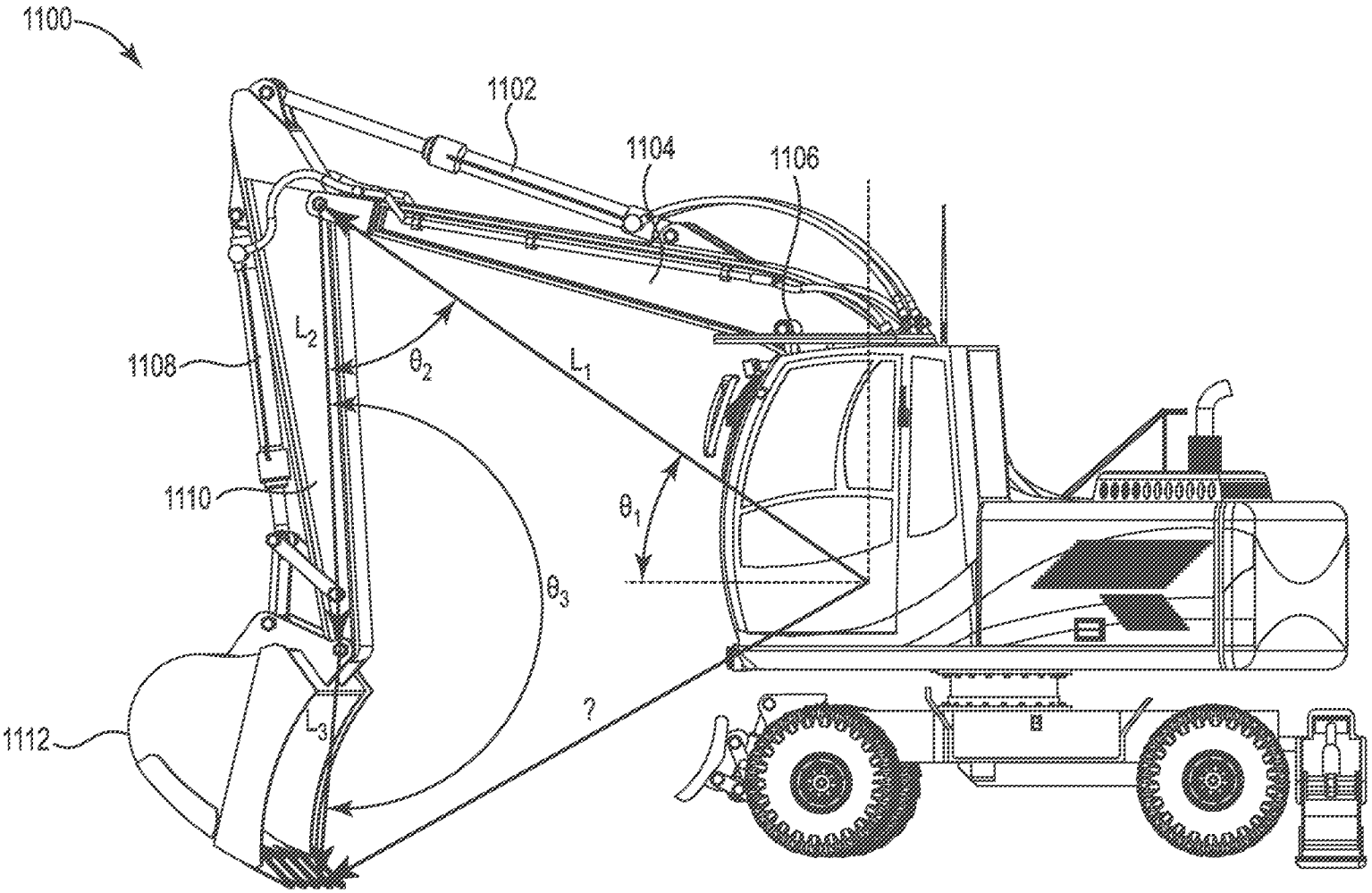
FIG. 11 is a diagram illustrating an excavator vehicle with three lengths and three tilt angles that may be used to estimate a position of the end effector according to one example.
Figure 12:
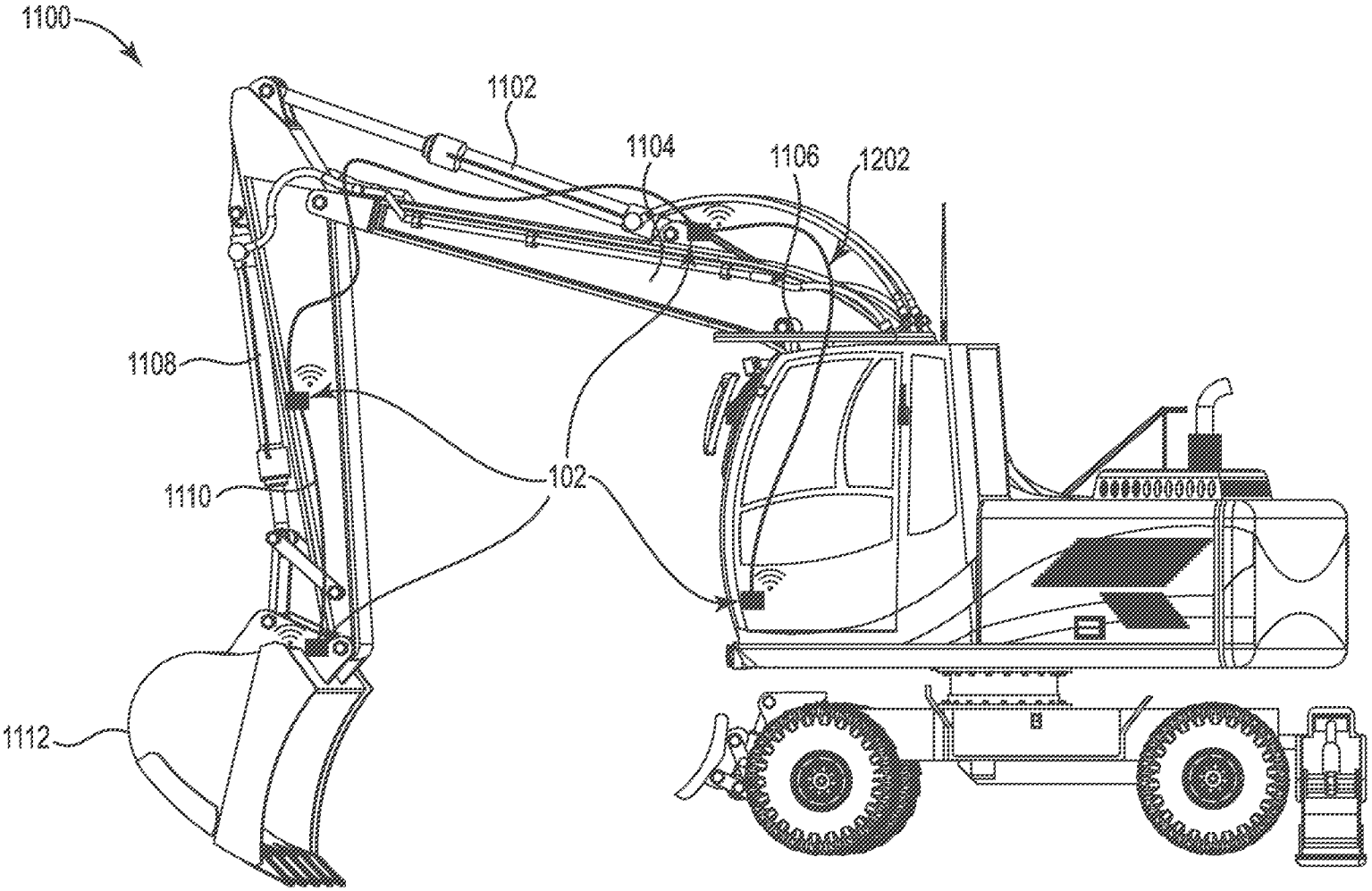
FIG. 12 is a diagram illustrating the excavator vehicle shown in FIG. 11 with a position estimation system that measures three rotational motions to determine the end effector position according to one example.

FIG. 11 is a diagram illustrating an excavator vehicle 1100 with three lengths and three tilt angles that may be used to estimate a position of the end effector according to one example. Excavator vehicle 1100 includes three hydraulic actuators 1102, 1106, and 1108 and two links 1104 and 1110 to move the end effector 1112, which is a bucket in this example. The length of the link 1104 is represented by $l_1$. The length of the link 1110 is represented by $l_2$. The length from the top of the end effector 1112 to the bottom of the end effector 1112 is represented by $l_3$. The angle of link 1104 relative to horizontal is represented by $\theta_1$. The angle between link 1104 and link 1110 is represented by $\theta_2$. The angle between link 1110 and the end effector 1112 is represented by $\theta_3$. The position of the bottom of the end effector 1112 is the position to be estimated, and this position is represented by an arrow with a question mark. FIG. 12 is a diagram illustrating the excavator vehicle 1100 shown in FIG. 11 with a position estimation system that measures three rotational motions to determine the end effector position according to one example. The position estimation system includes four IMUs 102, which are coupled together via a communication link 1202 for power and communications. In one example, the communication link 1202 includes a controller area network (CAN) bus that allows microcontrollers and other devices to communicate with each other without a host computer. A first IMU 102 is positioned near a top portion of the end effector 1112. A second IMU 102 is positioned on the link 1110. A third IMU 102 is positioned on the link 1104. A fourth IMU 102 is positioned on a base of the vehicle 1100.

The IMUs 102 may be used to estimate the angles $\theta_1$, $\theta_2$, and $\theta_3$ shown in FIG. 11, and this information, along with the known lengths $l_1$, $l_2$, and $l_3$, may be used to estimate the position of the end effector 1112. The IMU 102 located on the base of the vehicle 1100 may be used to measure reference signals that can be used to compensate for terrain slope and terrain induced vibrations. Other elements of system 100 (FIG. 1), such as computing device 106, may also be positioned on or in vehicle 1100.

Figure 13:
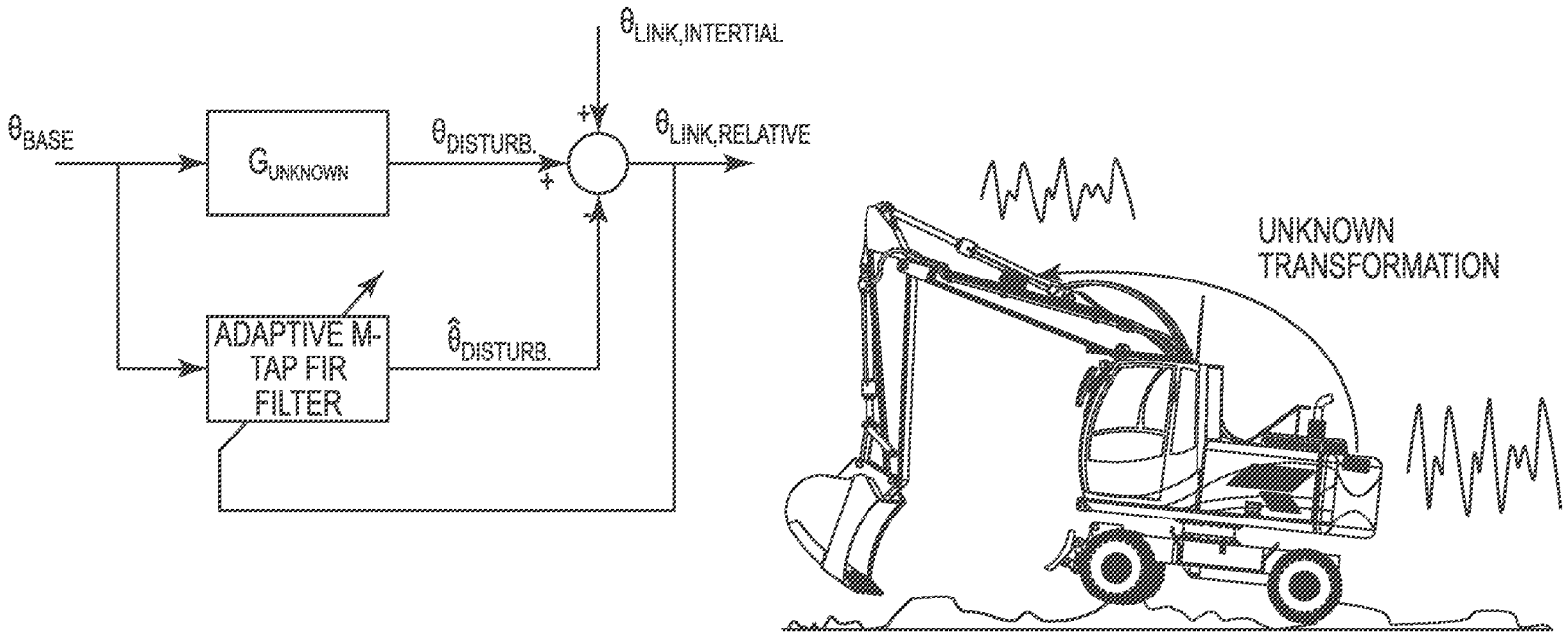
FIG. 13 is a diagram illustrating vibration and slope compensation according to one example.

FIG. 13 is a diagram illustrating vibration and slope compensation according to one example. In some examples, sensor data processing module 112 (FIG. 1) performs a method of removing the influence of terrain-induced slope and vibrations on acceleration signals. The module 112 may use the accelerometers and gyroscopes of an IMU on the vehicle base to provide a reference signal related to upstream measurement of terrain-induced disturbances that influence the accelerometers and gyroscopes on the link. For this method, $\theta_{base}$ the estimated base is tilt angle of the base, which, as shown in FIG. 13, is provided to an unknown transformation, $G_{unknown}$, and to an adaptive M-Tap finite impulse response (FIR) filter. This variable retains the information of road slope and static angle of the base, but does not retain high frequency vibrations. The unknown transformation is an unknown transfer function that relates the disturbance measured at the base to the disturbance at each IMU location. Since the influence of the disturbance (due to terrain slope and terrain-induced vibrations) on the IMU sensor signal is to be subtracted, the method figures out how the disturbance measured on the base is related to the disturbance experienced at the IMU sensor location. The unknown transfer function may be estimated using a filtered-x least mean squares (FXLMS) method. The adaptive FIR filter estimates the unknown transfer function and enables the disturbance at the IMU sensor location, $\hat{\theta}_{disturb}$, to be estimated. The unknown transformation outputs $\theta_{disturb}$, and the adaptive FIR filter outputs $\hat{\theta}_{disturb}$. $\theta_{disturb}$, $\hat{\theta}_{disturb}$, and $\theta_{link,inertial}$ are combined as shown in FIG. 13 to determine $\theta_{link,relative}$. $\theta_{link,inertial}$ is the estimated inertial tilt angle of the link, and $\theta_{link,relative}$ is the desired relative tilt angle of the link.

Some applications may involve the estimation of linear position of a structure (e.g., a telehandler arm). An IMU accelerometer may double integrated to obtain linear position changes, but the accelerometer does not determine absolute position, and an accelerometer may have drift when integrated. A laser time of flight sensor or other sensor may be used to measure absolute length, but may be lower bandwidth than an IMU. Some examples of the present disclosure combine an absolute position sensor, such as a laser time of flight sensor, with an IMU to provide inexpensive, accurate, and high bandwidth linear position estimation.

Some examples disclosed herein include a configuration of IMU sensors in order to be able to compute tilt angles of links on construction or other off-road vehicles. This configuration may include IMUs on individual links plus an IMU on the vehicle base. The inertial angles of the vehicle base and of the link may both be utilized to calculate relative angle of the link, thus removing the influence of terrain slope on tilt angle calculation. Some examples include a combination of an inexpensive laser sensor (e.g., ~$5) and an inexpensive IMU (e.g., ~$5) to compute linear position of a piston rod of a translational actuator. Some examples use an IMU on the vehicle base in order to obtain an upstream measurement of vibrations (induced by the road or by the engine), which is then utilized in an adaptive feedforward algorithm to cancel the effect of such vibrations on the IMUs located on the links. Examples disclosed herein include specific methods to calculate inertial tilt angles and to cancel the influence of vibrations. Some examples calculate end effector position using the sensors described herein; use the additional knowledge of load weight to compute real-time propensity of the vehicle to tip over; and prevent the tip-over from occurring by preventing dangerous motions of the vehicle links.

Some examples are directed to a method of using sensors together to create variables that could not be easily measured otherwise. Some examples provide a low-price alternative to other methods that may be used on agricultural and construction vehicles for end effector position determination.

Measurements of linear positions and angular positions of links on such actuators are currently either not done at all, or may be done using more expensive sensors (e.g., over $500), which may require drilling a hole through the entire length of the piston rod in a hydraulic cylinder. Such measurements may also be done using potentiometers, which are contacting sensors and prone to frequent failure. Compared to the such systems, some examples disclosed herein are ten times less expensive, can be installed on a vehicle with very little effort, and include only non-contacting sensors that are robust in performance.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An end effector position estimation system for an off-road vehicle, comprising:

at least one inertial measurement unit (IMU) configured to be positioned on at least one of actuators and links of the vehicle that together move an end effector of the vehicle, and configured to generate measurement signals;

at least one other IMU configured to be positioned on a base of the vehicle, and configured to generate other measurement signals; and a computing device to estimate a position of the end effector of the vehicle based at least in part on the measurement signals and the other measurement signals relative to a ground surface, wherein the computing device is configured to perform an estimation method that removes an influence of terrain-induced vibrations and terrain slope in the measurement signals based on the other measurement signals.

2. The end effector position estimation system of claim 1, wherein the estimation method includes adaptive feedforward disturbance removal.

3. The end effector position estimation system of claim 1, wherein the computing device estimates a real-time rotation or translation of each of the actuators and links in order to estimate the position of the end effector.

4. The end effector position estimation system of claim 1, wherein the off-road vehicle is one of an agricultural vehicle and a construction vehicle.

5. The end effector position estimation system of claim 1, and further comprising:

at least one range or linear translational position sensor to generate range information based on translation motions of at least one link of the vehicle with linear translational degrees of freedom; and wherein the computing device is configured to estimate the position of the end effector based further on the generated range information.

6. The end effector position estimation system of claim 5, wherein the at least one range or linear translational position sensor includes a low-cost laser sensor.

7. The end effector position estimation system of claim 5, and further comprising:

a combination of an inexpensive low bandwidth range sensor located on a translating arm of the vehicle together with an IMU located at a moving end of the translating arm to generate together an estimate of a translational motion of at least one link of the vehicle with linear translational degrees of freedom; and wherein the computing device is configured to estimate the position of the end effector based further on the generated estimate of translation motion.

8. The end effector position estimation system of claim 1, wherein the computing device is configured to determine whether the vehicle is operating within safe operating limits based at least in part on the estimated position of the end effector.

9. The end effector position estimation system of claim 8, wherein the computing device is configured to determine whether the vehicle is operating within safe operating limits based further on an estimated weight of a load carried by the end effector.

10. The end effector position estimation system of claim 1, wherein the system is configured to control the vehicle to prevent vehicle tip over based at least in part on the estimated position of the end effector.

11. The end effector position estimation system of claim 1, wherein the system is configured to prevent motion of the end effector into regions that may cause the vehicle to tip-over.

12. The end effector position estimation system of claim 1, wherein the system is configured to prevent motion of the end effector into a restricted region.

13. An end effector position estimation system for an off-road vehicle, comprising:

at least one inertial measurement unit (IMU) to be positioned on at least one of actuators and links of the vehicle that together move the end effector of the vehicle, and to generate measurement signals;

at least one other IMU to be positioned on a base of the vehicle, and to generate other measurement signals;

at least one laser range sensor to generate range information based on translation motion of at least one of the links of the vehicle with linear translational degrees of freedom; and a computing device to estimate real-time rotation or translation of each of the actuators and links based on the measurement signals, other measurement signals, and range information, to estimate a position of the end effector of the vehicle based on the estimated real-time rotation or translation of each of the actuators and links relative to a ground surface, and to remove an influence of terrain-induced vibrations in the measurement signals based on the other measurement signals.

14. The end effector position estimation system of claim 13, wherein the computing device determines whether the vehicle is operating within safe operating limits based at least in part on the estimated position of the end effector.

15. The end effector position estimation system of claim 13, wherein the system controls the vehicle to prevent vehicle tip over based on the estimated position of the end effector and an estimated weight of a load carried by the end effector.

16. A method, comprising:

generating measurement signals with at least one inertial measurement unit (IMU) positioned on at least one of actuators and links of an off-road vehicle that together move an end effector of the vehicle;

generating other measurement signals with at least one other IMU positioned on a base of the vehicle;

compensating the measurement signals for terrain-induced vibrations based on the other measurement signals provided by the at least one other IMU positioned on the base of the vehicle; and estimating a position of the end effector of the vehicle based at least in part on the compensated measurement signals relative to a ground surface.

17. The method of claim 16, and further comprising:

determining whether the vehicle is operating within safe operating limits based at least in part on the estimated position of the end effector.

18. The end effector position estimation system of claim 1, wherein the estimation method includes referencing the other measurement signals generated by the at least one other IMU on the base of the vehicle to provide a reference signal relating to upstream measurement of terrain-induced disturbances that influence the measurement signals generated by the IMU positioned on at least one of the actuators and links of the vehicle.

19. The end effector position estimation system of claim 13, wherein the at least one laser range sensor measures a current length of a telescoping arm of the vehicle.

* * * * *